US007353911B1

(12) United States Patent
Freeman

(10) Patent No.: US 7,353,911 B1
(45) Date of Patent: Apr. 8, 2008

(54) SCAFFOLD SHELF

(76) Inventor: Thomas A. Freeman, 208 Golf Club La., Venice, FL (US) 34293

( * ) Notice: Subject to any disclaimer, the term of this patent is extended or adjusted under 35 U.S.C. 154(b) by 0 days.

(21) Appl. No.: 11/497,201

(22) Filed: Aug. 1, 2006

(51) Int. Cl.
*E04G 1/00* (2006.01)

(52) U.S. Cl. ..... 182/129; 248/238

(58) Field of Classification Search ..... 182/129; 248/210, 238; 211/90.1, 100, 86.01, 119.03
See application file for complete search history.

(56) References Cited

U.S. PATENT DOCUMENTS

| | | | | |
|---|---|---|---|---|
| 271,509 | A * | 7/1883 | Nolton | 248/238 |
| 352,716 | A * | 11/1886 | Slacj | 182/121 |
| 2,897,013 | A | 7/1959 | Delp | |
| 3,493,208 | A | 2/1970 | Sato | |
| 4,632,222 | A | 12/1986 | Chen | |
| 5,158,023 | A | 10/1992 | Allen | |
| 5,259,477 | A | 11/1993 | Fears et al. | |
| 5,788,198 | A | 8/1998 | Sharpe | |
| 5,833,190 | A | 11/1998 | Bishop | |
| 6,189,652 | B1 * | 2/2001 | Brown et al. | 182/121 |
| 6,691,825 | B2 | 2/2004 | Haig | |
| 6,942,063 | B1 * | 9/2005 | Huett, Jr. | 182/129 |

* cited by examiner

*Primary Examiner*—Alvin Chin-Shue
(74) *Attorney, Agent, or Firm*—Charles J. Prescott

(57) ABSTRACT

A removable shelf for attachment to a scaffold including a generally L-shaped frame releasably connectable around one of the vertically spaced horizontal crossbars of the scaffold. An object support panel is connected to one or both of the legs to support objects thereatop. Each leg is of sufficient length to extend between two vertically adjacent crossbars so that a distal portion of one leg contacts a lower one of the two crossbars to maintain the substantially horizontal orientation of the other leg and corresponding support panel when weighty objects are placed thereatop.

6 Claims, 4 Drawing Sheets

16a
12
16'
10'
22
26
A
V
36'
14
B
16b
E

SCAFFOLD SHELF

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to accessories for scaffolds, and more particularly to a self-supporting releasably connectable shelf for attachment to a scaffold for holding objects such as working implements, paints and the like.

2. Description of Related Art

Workmen utilizing scaffolds for various phases of construction and building repair typically stand on a lower platform of the scaffolding while work is being done on a particular portion of the building, the scaffolding then being movable from place to place to continue construction operations.

Typical scaffolds are formed of elongated tubular or angle members which are either bolted or welded together at their ends. Very little attention is typically given by scaffold manufacturers to accessories which will assist a worker in holding weighty objects during completion of the work task at hand.

Prior art discloses a number of previous accessories attachable to scaffolds to assist the worker in more effectively utilizing the scaffold by more conveniently supporting work objects and more efficiently attaching additional horizontal platforms for moving about during working conditions. The following U.S. patents embody those notions.

U.S. Pat. No. 5,158,023 to Allen teaches a scaffold table for removable attachment to scaffolding and U.S. Pat. No. 3,493,208 to Sato discloses a bracket for fastening boards or other projections to a scaffold.

Fears, et al. discloses a collapsible scaffold bracket in U.S. Pat. No. 5,259,477 and an adjustable ladder stabilizer and tool holder is taught by Haig in U.S. Pat. No. 6,691,825. U.S. Pat. No. 5,788,198 to Sharpe discloses a bracket for mounting a ladder shelf and Chen teaches a scaffold with spring locking members which are releasably attached supporting a shelf in U.S. Pat. No. 4,632,222. U.S. Pat. No. 5,833,190 to Bishop teaches a shelf-supporting bracket for a scaffold. Other patents are of interest as follows:

U.S. Pat. No. 3,473,774 to Riblet
U.S. Pat. No. 2,897,013 to Delp
U.S. Pat. No. 2,342,427 to Riblet
U.S. Pat. D412,754 to Harden
U.S. Pat. No. 5,535,974 to Savitski
U.S. Pat. No. 6,158,551 to Gray
U.S. Pat. No. 6,902,034 to Gibson, et al.

The present invention provides a simple, removable, releasably attachable shelf for attachment to the vertically spaced horizontal crossbars of a scaffold and, in the preferred embodiment, offers true horizontal double or dual working surfaces for supporting heavy or weighty objects. This dual surface feature facilitates quickly and easily reorienting the unit to extend inwardly of the imaginary envelope of the scaffold or outwardly thereof depending upon the task at hand and preference of the worker. Note that the base unit may be manually removed and reattached to reorient its single working surface as well.

BRIEF SUMMARY OF THE INVENTION

This invention is directed to a removable shelf for attachment to a scaffold including a generally L-shaped frame releasably connectable around one of the vertically spaced horizontal crossbars of the scaffold. An object support panel is connected to one or preferably, both of the legs to support objects thereatop. Each leg is of sufficient length to extend between two vertically adjacent crossbars so that a distal portion of one leg contacts a lower one of the two crossbars to maintain and stabilize the substantially horizontal orientation of the other leg and corresponding support panel when weighty objects are placed thereatop without interfering with the quick and convenient installation and removal aspects of this invention.

It is therefore an object of this invention to provide a releasably connectable shelf for attachment to a scaffold which provides a horizontal work surface for supporting work objects thereatop.

It is yet another object of this invention to provide a releasably attachable shelf for attachment to a scaffold which is completely self-supporting when attached to the scaffold.

Yet another object of this invention is to provide a quickly removable shelf for easy attachment to a scaffold which provides two alternate working positions wherein the horizontal support panel is either inwardly or outwardly extended with respect to the upright perimeter profile of the scaffolding itself.

Still another object of this invention is to provide a two-panel releasably connectable utility shelf for attachment to a scaffold which is easily positionable either inwardly of or outwardly from the outer vertical profile of the scaffolding depending upon worker preference without the need to remove the unit and reattach it in the opposite orientation.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
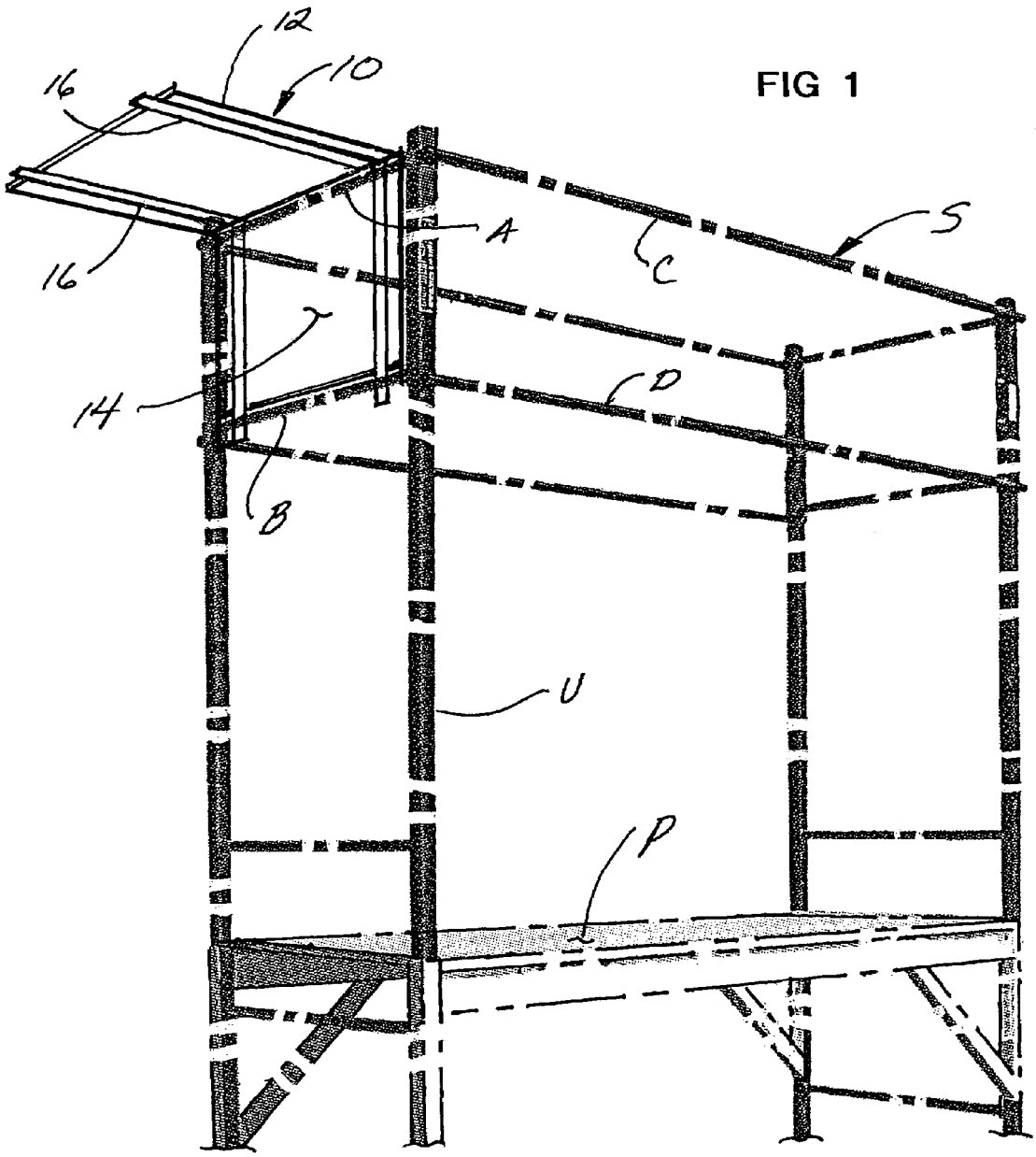
FIG. 1 is a perspective view of a typical scaffold showing one embodiment of the invention releasably attached thereto in an outwardly extended orientation.

Referring now to the drawings, and firstly to FIG. 1, a typical tubular scaffold is there shown in phantom generally at S and includes a plurality of horizontally spaced upright tubular members U and a horizontally spaced plurality of horizontal tubular members A, B, C, and D. A horizontal working platform P is provided atop which a worker may stand to accomplish the task at hand typically adjacent a building or wall structure.

One embodiment of the invention is shown generally at numeral 10 in FIG. 1 releasably connected to and supported by two adjacent, vertically spaced apart crossbars A and B. This embodiment 10 includes two horizontal support panels 12 and 14 which are mechanically attached to the generally orthogonally oriented legs of two spaced apart L-shaped frames 16.

Figure 2:
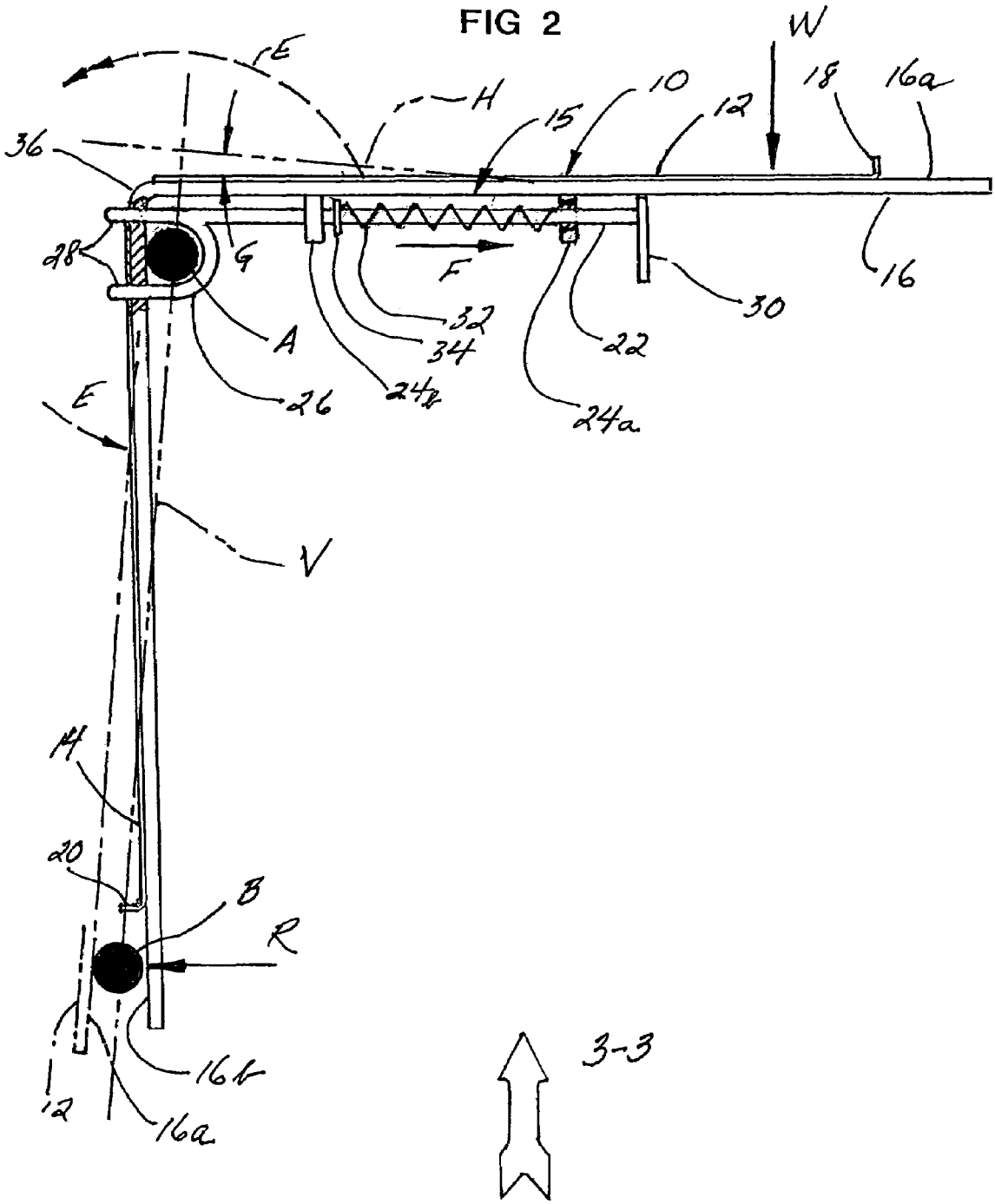
FIG. 2 is a side elevation partially broken view of the invention shown in FIG. 1.
Figure 3:
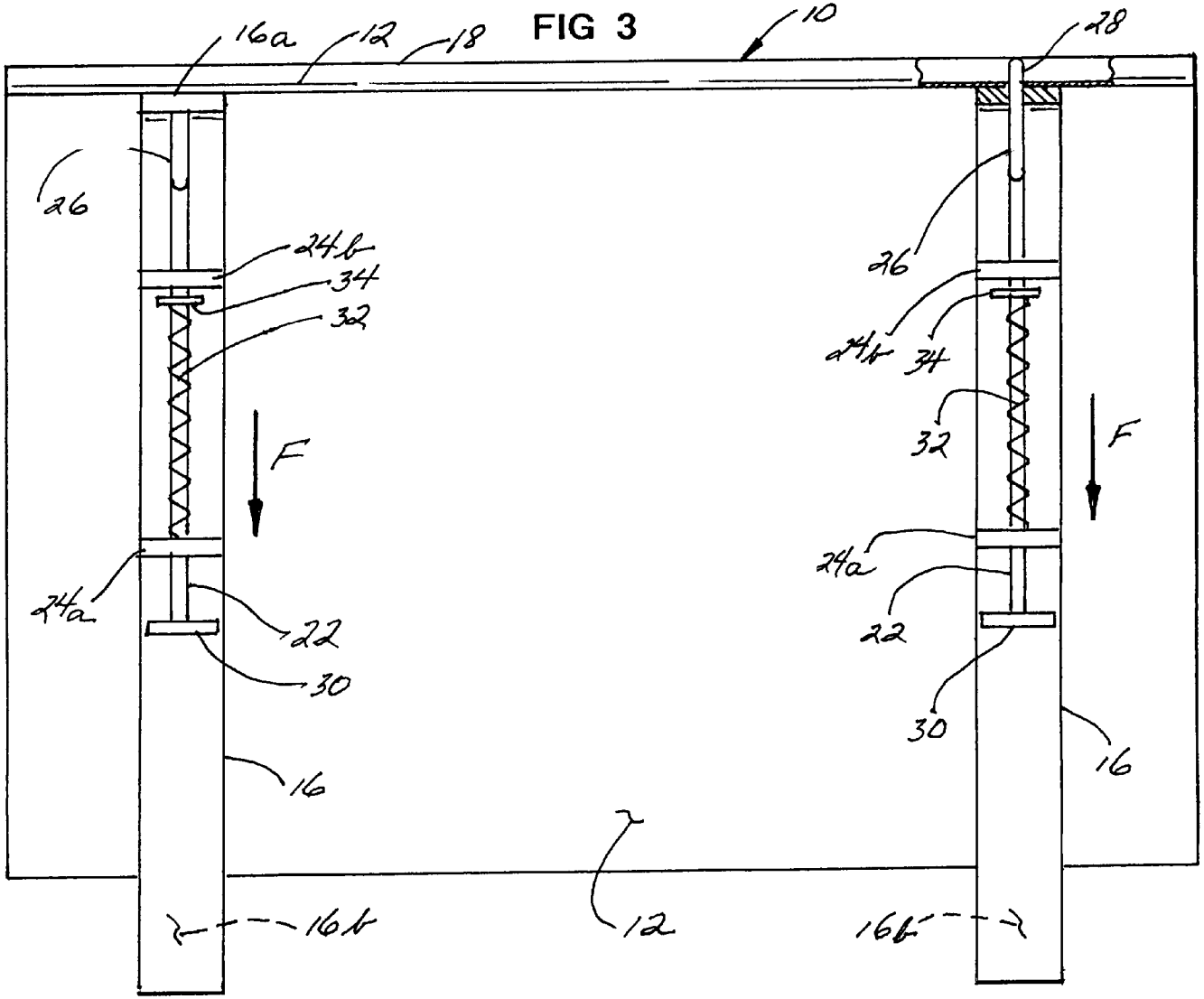
FIG. 3 is a bottom plan view in the direction of arrow 3-3 in FIG. 2.

As better seen in FIGS. 2 and 3, this embodiment 10 includes two spaced apart L-shaped frames 16 each of which generally each orthogonally formed at a central fold or apex 36 thereof so that distal portions 16*a* and 16*b* are orthogonally oriented as shown for contact with the lower one of the elongated horizontal crossbars B. Object support panels 12 and 14 span across and connect the corresponding legs of each of the L-shaped frames 16 so as to generally meet at the apex 36 of each of the frames 16 and terminate at outwardly extending catch flanges 18 and 20 so as to prevent tools and other working objects from easily sliding away from the worker and off of the distal edges of the corresponding horizontal panel 12 or 14.

A spring biased releasable engagement member 15 is attached by supports 24*a* and 25*b* to the inner surfaces of one of the legs of each of the frames 16. Each of these engagement members 15 includes an elongated shaft 22 having a pull handle 30 disposed at one end thereof and a U-shaped crossbar engaging member 26 formed at the other end thereof. The crossbar engagement member 26 generally has two spaced prongs 28 which are sized to snugly fit over the outer diameter of the crossbar A to entrap the crossbar A against the inner surfaces of the frames 16 to snugly support the shelf 10, yet to allow for free rotation of the entire shelf 10 in the direction of arrow E about the longitudinal axis of the crossbar A.

A compression biasing spring 32 is positioned around shaft 22 between one of the supports 24*a* and a stop 34 attached to the shaft 22 so as to maintain member 15 in the closed or locked position as shown except when manually moved to an open position in the direction of arrow 8 by manually moving handle 30 in the direction of arrow F to disengage the crossbar engaging member 26 from around the crossbar A.

When weight W is placed atop the support panel 12 when the shelf 10 is in the orientation shown in FIGS. 1, 2 and 3, the lower distal portion 16*b* engages against crossbar B at R so as to prevent any rotational movement of the shelf 10. In the position shown in FIG. 2, the support panel 12 extends to the right of the crossbar A. By rotation of the shelf 10 in the counter-clockwise direction of arrow E, the support panel 12 takes on a generally upright orientation shown in phantom wherein distal portion 16*a* then receives support from further rotation against the opposite side of crossbar B and further wherein the support panel 14 then moves into a generally horizontal orientation (not shown in FIG. 2) extending laterally to the left or away from the orientation previously established by support panel 12.

Still referring specifically to FIG. 2, in this embodiment 10, each of the legs of the frames 16 are oriented orthogonally or at 90° one to another as shown. Typically, any two of the vertically spaced crossbars A and B are oriented vertically one to another about an imaginary vertical line V so that support panel 12 becomes oriented at a slight angle G to horizontal H. This results in the support panel 12 (or 14) being tipped slightly upwardly toward the distal edge and flange 18 (or 20) so that objects placed thereatop may inadvertently roll toward the worker.

Figures 4, 5:
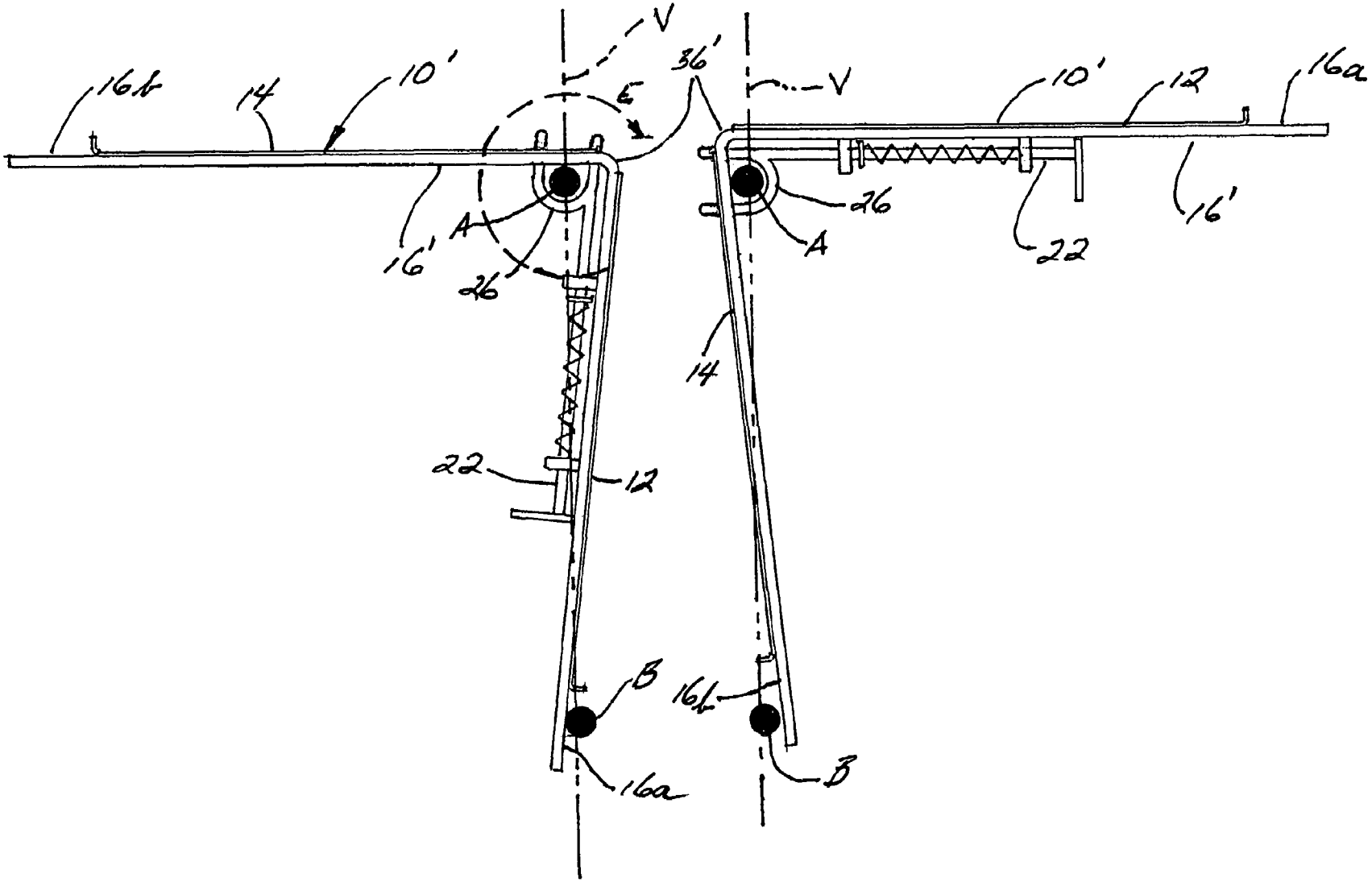
FIG. 4 is an end elevation view of another embodiment of the invention shown in a first working position attached to a scaffold.
FIG. 5 is an end elevation view of FIG. 4 showing this embodiment 10' in an alternate working position.

To improve upon this minor inconvenience of feature, the embodiment 10' shown in FIGS. 4 and 5 is provided and is generally preferred. By orienting the legs of the generally L-shaped frame 16' at an angle at apex 36' of slightly less than orthogonal or in the range of about 85°, each of the support panels 12 and 14 become substantially horizontally oriented. Thus, whether this embodiment 10' is oriented to the left of (or outward from) the crossbars A and B, with support panel 14 being the horizontal work surface or, whether after rotation of the device 10' about the upper crossbar A in the direction of arrow E, support panel 12 becomes horizontally positioned and oriented to extend inwardly with respect to the crossbars A and B, a substantially horizontal working surface is always provided for the worker and is easily selectable without the need to remove the device 10' for reattachment in the opposite direction.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A removable shelf for attachment to a scaffold comprising:

a generally L-shaped frame having an apex area and first and second legs and including a releasable engagement arrangement connectable around one of a plurality of vertically spaced horizontal crossbars of the scaffold to secure said apex area to the crossbar for substantially only pivotal movement of said frame on and about a longitudinal axis of the crossbar;

an object support panel connected to each of said first and second legs;

said first leg being of sufficient length to extend between two vertically adjacent crossbars wherein, when said apex area is releasably secured by said engagement member around an upper one of the two crossbars with said second leg and corresponding support panel being substantially horizontally disposed, a distal portion of said first leg contacts a lower one of the two crossbars to maintain the substantially horizontal orientation of said second leg and corresponding support panel when objects are, placed atop said support panel attached to said second leg;

said engagement arrangement including an elongated shaft held on said frame for sliding longitudinal translation of said shaft, said shaft having a U-shaped crossbar engaging member formed at one end of said shaft and a pull handle connected to another end of said shaft, said shaft being biased toward the upper crossbar to maintain said crossbar engaging member in a closed position against the upper crossbar.

2. A removable shelf as set forth in claim 1, wherein:

said legs are oriented one to another at an angle slightly less than orthogonal to establish a true horizontal positioning of one said leg and corresponding said support panel.

3. A removable shelf for attachment to a scaffold comprising:

a generally L-shaped frame having an apex area and first and second legs and including spaced apart releasable engagement members for connection around one of a plurality of vertically spaced horizontal crossbars of the scaffold to secure said apex area to the crossbar for substantially only pivotal movement of said frame on and about a longitudinal axis of the crossbar;

an object support panel connected to each of said first and second legs;

each of said legs having a length sufficient to span two vertically adjacent crossbars wherein, when said apex area is releasably secured by said engagement member around an upper one of the two crossbars with one said leg and corresponding support panel being substantially horizontally disposed, a distal portion of the other said leg contacts a lower one of the two crossbars to maintain the substantially horizontal orientation of said one leg and corresponding support panel when objects are placed atop said support panel attached to the other said leg;

said engagement arrangement including an elongated shaft dependently held on said frame for sliding longitudinal translation, said shaft having a U-shaped crossbar engaging member formed at one end of said shaft and a pull handle connected to another end of said shaft, said shaft being biased toward the upper crossbar to maintain said crossbar engaging member in a closed position against the upper crossbar.

4. A removable shelf as set forth in claim 3, wherein:

said legs are oriented one to another at an angle slightly less than orthogonal to establish a true horizontal positioning of one said leg and corresponding said support panel.

5. A removable shelf for attachment to a scaffold comprising:

a generally L-shaped frame having an apex area and first and second legs and including a releasable engagement arrangement connectable around one of a plurality of vertically spaced horizontal crossbars of the scaffold to secure said apex area to the crossbar for substantially only pivotal movement of said frame on and about a longitudinal axis of the crossbar between a first and a second position;

an object support panel connected to each of said first and second legs;

each of said legs being of sufficient and substantially identical length to extend between two vertically adjacent crossbars wherein, when said apex area is releasably secured by said engagement member around an upper one of the two crossbars and said frame is in the first position with said second leg and corresponding support panel being substantially horizontally disposed in a first lateral direction, a distal portion of said first leg contacts a lower one of the two crossbars to maintain the substantially horizontal orientation of said second leg and corresponding support panel when objects are placed atop said support panel attached to said second leg;

said frame being pivotable about the upper crossbar into the second position with said first leg and corresponding support panel being substantially horizontally disposed in a second lateral direction opposite from the first lateral direction, a distal portion of said second leg contacting a lower one of the two crossbars to maintain the substantially horizontal orientation of said first leg and corresponding support panel when objects are placed thereatop; said engagement arrangement includes an elongated shaft dependently held on said frame for sliding longitudinal translation of said shaft, said shaft having a U-shaped crossbar engaging member formed at one end of said shaft and a pull handle connected to another end of said shaft, said shaft being biased towards the upper crossbar to maintain said crossbar engaging member in a closed position against the upper crossbar.

6. A removable shelf as set forth in claim 5, wherein:

said legs are oriented one to another at an angle slightly less than orthogonal to establish a true horizontal positioning of one said leg and corresponding said support panel.

* * * * *